US007017512B2

(12) United States Patent
Laird et al.

(10) Patent No.: US 7,017,512 B2
(45) Date of Patent: Mar. 28, 2006

(54) FLAG MOUNTING KIT AND METHOD OF USING SAME

(75) Inventors: Raymod Alan Laird, Mission Viejo, CA (US); William John Riordan, San Diego, CA (US)

(73) Assignee: William J Riordan, San Diego, CA (US)

( * ) Notice: Subject to any disclaimer, the term of this patent is extended or adjusted under 35 U.S.C. 154(b) by 0 days.

(21) Appl. No.: 10/909,708

(22) Filed: Aug. 2, 2004

(65) Prior Publication Data

US 2006/0021562 A1 Feb. 2, 2006

(51) Int. Cl.
*G09F 17/00* (2006.01)

(52) U.S. Cl. ..... 116/174; 116/173

(58) Field of Classification Search ..... 116/173, 116/174, 175, 28 R
See application file for complete search history.

(56) References Cited

U.S. PATENT DOCUMENTS

| | | | | | |
|---|---|---|---|---|---|
| 394,983 | A | * | 12/1888 | Hurley | 116/173 |
| 1,119,147 | A | * | 12/1914 | Fillmore | 116/174 |
| 1,595,395 | A | * | 8/1926 | Herbener | 116/173 |
| 1,646,467 | A | * | 10/1927 | Walton | 116/174 |
| 2,322,891 | A | * | 6/1943 | Snyder | 116/173 |
| 2,368,783 | A | | 2/1945 | Schillinger | |
| 2,732,823 | A | * | 1/1956 | Hanson | 116/173 |
| 2,794,414 | A | * | 6/1957 | Reifschneider | 116/173 |
| 2,799,240 | A | * | 7/1957 | Andrews | 116/174 |
| 3,091,215 | A | * | 5/1963 | Kenmore | 116/173 |
| 3,183,886 | A | * | 5/1965 | Moffitt, Jr. | 116/173 |
| 4,144,833 | A | * | 3/1979 | Newman, Sr. | 116/28 R |
| 4,452,167 | A | | 6/1984 | Burroughs | |
| 4,554,885 | A | | 11/1985 | Burny, Jr. | |
| 4,574,726 | A | * | 3/1986 | Sullivan | 116/28 R |
| 4,603,652 | A | | 8/1986 | Thibault et al. | |
| 4,864,962 | A | * | 9/1989 | Kuehl et al. | 116/174 |
| 5,279,250 | A | | 1/1994 | Palermo, Jr. et al. | |
| 5,291,849 | A | | 3/1994 | Zeitler | |
| 5,335,621 | A | | 8/1994 | Willis et al. | |
| 5,373,287 | A | * | 12/1994 | Doublet | 340/825.69 |
| 5,375,555 | A | | 12/1994 | Dolan | |
| 5,383,420 | A | | 1/1995 | Dundorf | |
| 5,402,746 | A | | 4/1995 | Deschamps | |
| 5,495,821 | A | | 3/1996 | Brewer | |
| 5,522,342 | A | | 6/1996 | Chen Chao | |
| 5,697,321 | A | | 12/1997 | Dobbins | |
| 5,701,840 | A | | 12/1997 | Cross | |
| 5,870,968 | A | | 2/1999 | Dundorf | |
| 5,884,578 | A | | 3/1999 | Thostrup et al. | |
| 5,943,980 | A | | 8/1999 | Huang | |
| 5,975,009 | A | | 11/1999 | Nihra et al. | |

(Continued)

*Primary Examiner*—Christopher W. Fulton
*Assistant Examiner*—Amy R. Cohen

(57) ABSTRACT

A method and kit for mounting a flag to a flagpole includes providing a mounting kit having a flagpole, a sealed bearing with an inside diameter dimension selected to correspond to an outside diameter dimension of the flagpole; a tie; a flexible coupler and a flag with a sufficiently stiff pole-side hemmed edge extending between a top flag eyelet and a bottom flag eyelet to help hold the pole-side hemmed edge straight for full flag display purposes; and then, following the instructions within the kit, mounting the flagpole to a stationary surface, securing the sealed bearing to a top portion of the flagpole, passing the tie through the top one of the pair of flag eyelets to secure a top portion of the flag to the bearing with the tie; and securing the flexible coupler between the bottom one of the pair of eyelets and the flagpole, thereby mounting the flag for free rotation about the flagpole in windy conditions.

16 Claims, 3 Drawing Sheets

U.S. PATENT DOCUMENTS 6,293,221 B1 9/2001 Kinahan
6,584,928 B1 7/2003 Kinahan
6,595,364 B1 * 7/2003 Palermo et al. ..... 206/443
6,807,924 B1 * 10/2004 Christiansen ..... 116/174
6,857,386 B1 * 2/2005 Brewer ..... 116/174
2003/0213425 A1 * 11/2003 Spiegel ..... 116/173

* cited by examiner

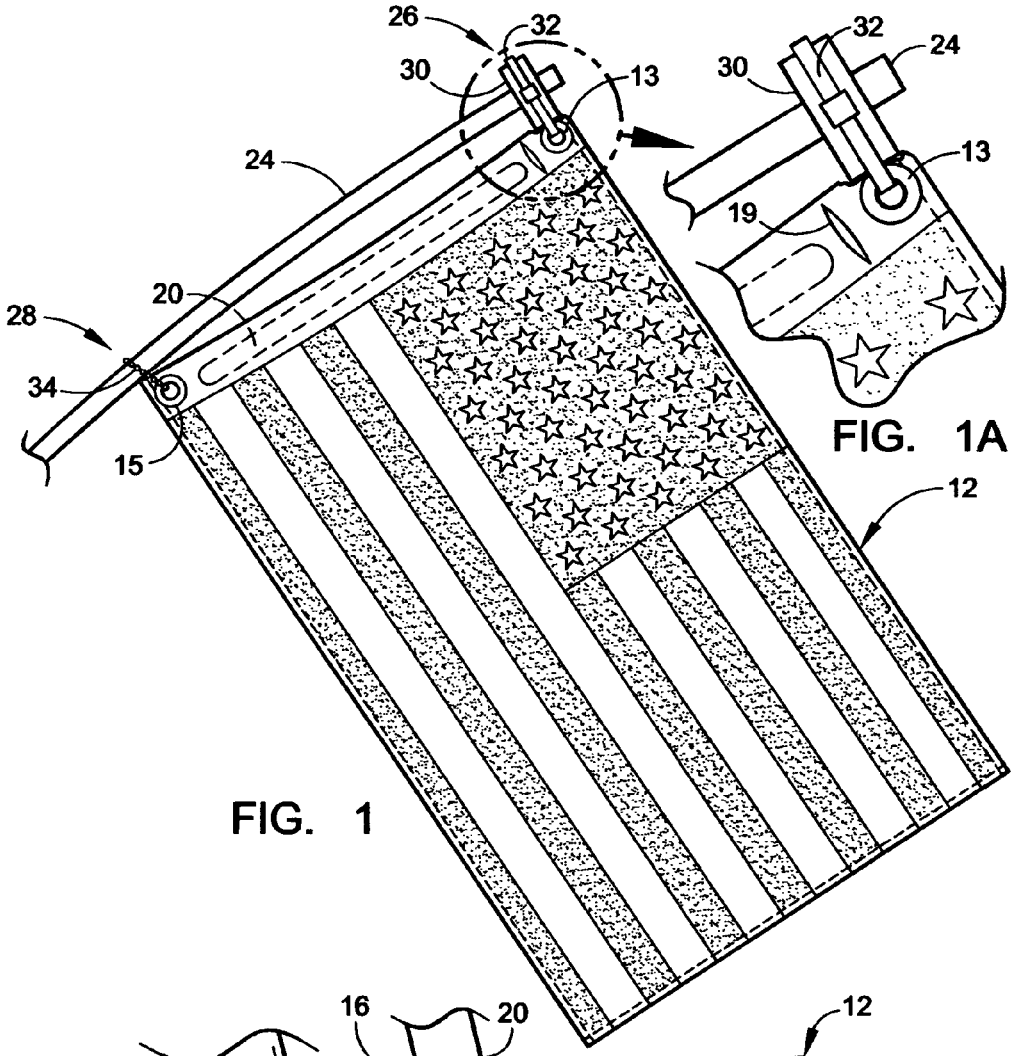
FIG. 1
FIG. 1A
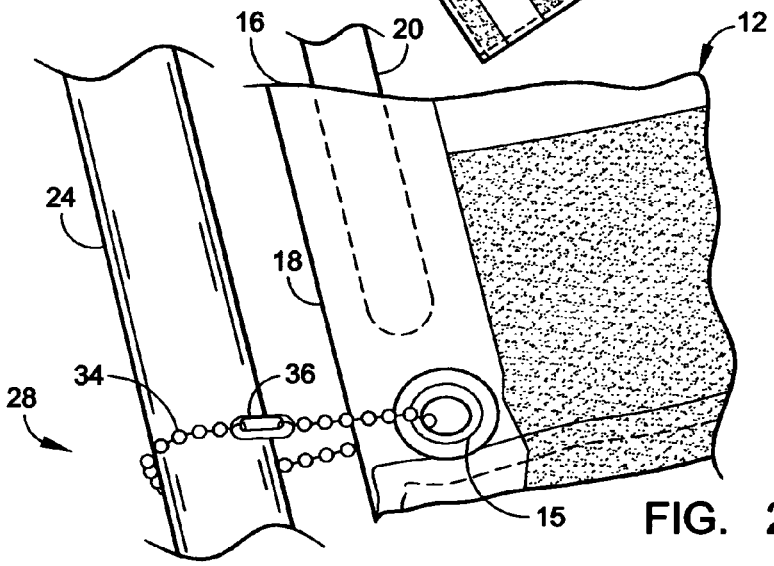
FIG. 2

FLAG MOUNTING KIT AND METHOD OF USING SAME

FIELD OF THE INVENTION

This invention relates generally to flag mounting arrangements and more particularly to a non-furling flag mounting kit and method of using the kit.

BACKGROUND OF THE INVENTION

Pole mounted flags when whipped by the wind tend to wrap partially or totally around their supporting pole. Therefore, it would be highly desirable to have a new and improved flag mounting kit and method of using the kit that not only secures a flag to a mounting pole but also that secures the flag to the mounting pole in such a manner so as to completely eliminate furling of the flag about its associated mounting pole.

SUMMARY OF THE INVENTION

A method and kit for mounting a flag to a flagpole includes providing a mounting kit having a flagpole, a sealed bearing with an inside diameter dimension selected to correspond to an outside diameter dimension of the flagpole; a tie; a flexible coupler and a flag with a sufficiently stiff pole-side hemmed edge extending between a top flag eyelet and a bottom flag eyelet to help hold the pole-side hemmed edge straight for full flag display purposes; and then, following the instructions within the kit, mounting the flagpole to a stationary surface, securing the sealed bearing to a top portion of the flagpole, passing the tie through the top one of the pair of flag eyelets to secure a top portion of the flag to the bearing with the tie; and securing the flexible coupler between the bottom one of the pair of eyelets and the flagpole, thereby mounting the flag for free rotation about the flagpole in windy conditions.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings wherein:

FIG. 1 is a pictorial view of a mounted flag using a flag mounting kit constructed in accordance with the present invention;

FIG. 1A is an enlarged pictorial view of an upper portion of the mounted flag of FIG. 1;

FIG. 2 is a cutaway pictorial view of a bottom portion of the flag and mounting kit of FIG. 1;

DETAILED DESCRIPTION OF PREFERRED EMBODIMENTS

Figure 3:
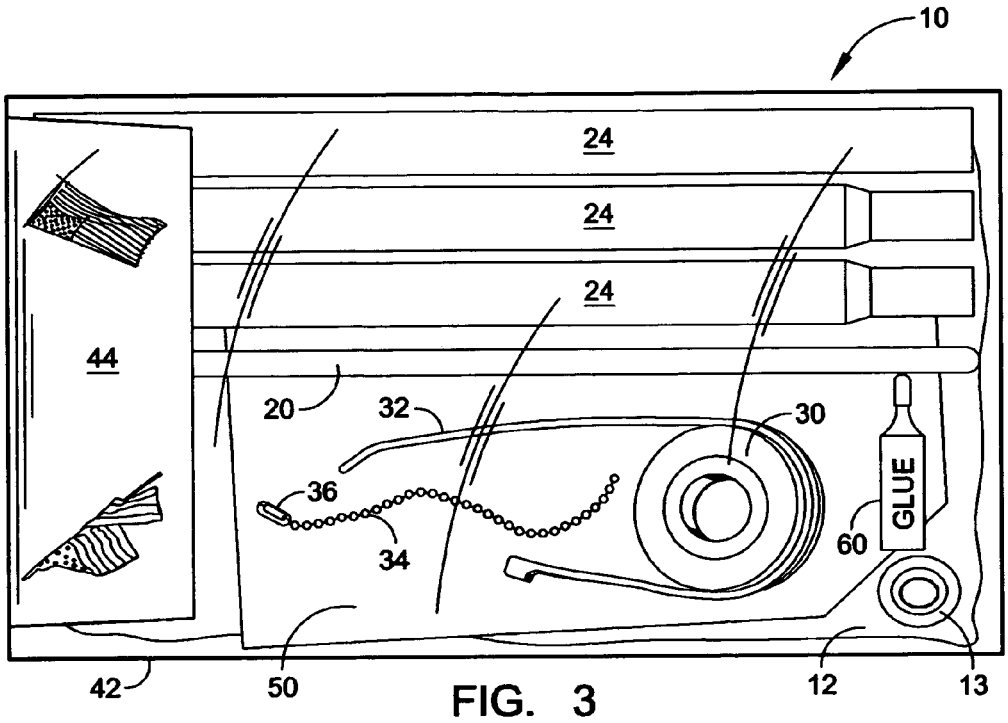
FIG. 3 is a perspective view of a packaged mounting kit, which is constructed in accordance with the present invention.

Referring now to the drawings and more particularly to FIGS. 1–3 there is illustrated a flag mounting kit 10, which is constructed in accordance with the present invention. The flag mounting kit 10 when used in accordance with a novel method of using the kit 10 provides all the essential components for mounting a flag 12 so as to substantially, if not completely, eliminate furling of the flag 12 under windy conditions. The kit 10 is inexpensive and easy to use and assemble without the use of any special tools.

Considering now the flag mounting kit 10 in greater detail with reference to FIGS. 1–3, the flag mounting kit 10 generally comprises a flag 12 of a suitable size having a stiff hem pocket 16, which extends along an inner inside edge 18 thereof where the outer longitudinal ends of the pocket 16 are defined by a corresponding pair of eyelets 13 and 15 respectively.

The hem pocket 16 is dimensioned to receive therein in a relatively snug tight fit, a stiffener rod or dowel 20 that facilitates providing a full flag display without introducing any source of friction. In order to assure that the stiffener rod 20 does not dislodge from the pocket 16 under windy conditions, the pocket 16 is provided with a top pocket flap 19 as best seen in FIG. 1A which secures the pocket 16 in a closed position with a set of hook and pile closures otherwise known as a Velcro closure. As will be explained hereinafter in greater detail, the rod 20 is prevented from escaping the pocket 16 due to the manner in which kit 10 allows the lower portion of the flag 12 to be mounted.

As best seen in FIGS. 1–2, the stiffener rod 20 functions to help retain the inner inside edge 18 of the flag 12 in substantially parallel alignment with an associated segmented tubular flagpole 24, which also forms part of the mounting kit 10. While in the preferred embodiment of the present invention the flap or opening 19 for the flag pocket 16 is shown disposed below the top flag eyelet 13, it is contemplated that the opening could also be disposed at the top edge of the flag.

In the preferred embodiment of the present invention, the inner inside edge 18 of the flag 12 is held stiff by the dowel or rod 20. However, it is contemplated within the true scope and spirit of the present invention that the side edge portion 18 of the flag 12 could be constructed with a weighted or heavily weaved hem that would provide an equivalent amount of side edge stiffing. Similarly, the flag 12 could have a plastic stay or stiffener that is permanently sown into the flag at about its inner inside edge. It should be noted that the dowel or stiffener rod 20 could be constructed of any suitable stiffing material such as wood, nylon or, polyethylene tubing. In this regard, the material chosen for the dowel 20 is merely a matter of design choice and cost. What is of importance however is that the end portions of the dowel 20 be smooth and rounded so as not to puncture or tear the pocket 16, thereby allowing the rod 20 to escape from the pocket 16 of the flag 12. The dowel 20 may also be a segmented dowel having at least two separate members.

Figure 5:
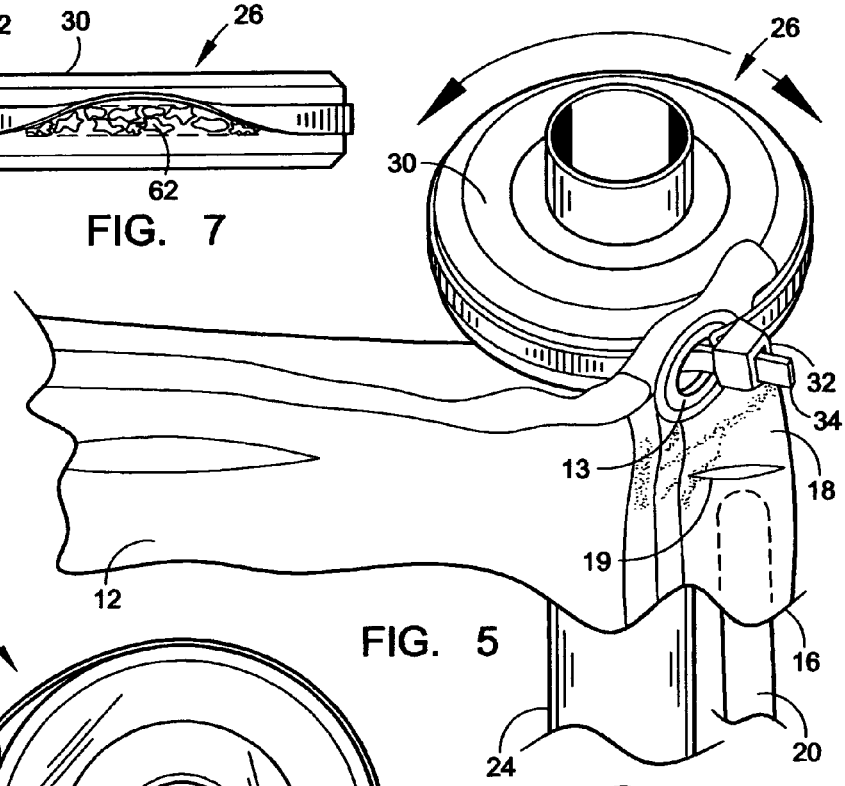
FIG. 5 is a cutaway pictorial view of a top portion of the flag and mounting kit of FIG. 1.

The flag mounting kit 10 also includes mounting hardware in the form of a top mounting arrangement 26, which comprises a push on sealed bearing 30, and a tie wrap 32 and bottom mounting arrangement 28, which comprises a ball chain 34 with locking clasp 36. The top mounting arrangement 26 and the bottom mounting arrangement 28, cooperate together between the flag 12, the eyelets 13, 15 and the flagpole 24 to provide a unique single point design that allows the flag 12 to spin about the bearing 30 and flagpole 24 instead of wrapping around the flagpole 24. This single point design provides a horizontally and rotationally unconstrained lower anchor combined with a horizontally constrained upper anchor cooperating to eliminate horizontal forces between eyelets of the flag along the flagpole. In the preferred embodiment of the present invention, the sealed bearing 30 is a low friction bearing having an outside diameter dimension and an inside diameter dimension, where the inside diameter dimension is chosen to substantially correspond to the outside diameter dimension of the flagpole 24. In this manner, the sealed bearing 30 can be pushed onto a top portion of the flagpole 24 in a friction tight fit as best seen in FIG. 5. It should also be understood by those skilled in the art, that the sealed bearing 30 prevents dirt and other debris from entering the bearing area thereby greatly extending the reliability and durability of the life of the bearing 30.

Considering now the method of using the flag mounting kit 10 in greater detail with reference to FIGS. 1–6, the flag mounting kit 10 is conveniently arranged for shipping purposes in a sealed pouch 42 having an easy rip open resealable flap 44. The pouch 42 is sufficiently large in volume to include the flag 12, the rod 20, the push on bearing 30, and the top and bottom mounting arrangements 26 and 28 respectively. A bottle 60 of quick setting glue 62 is also provided to help permanently affix the tie 32 to the bearing 30. It should be understood however, by those skilled in the art, that the tie 32 when sufficiently tightened and closed cannot be dislodged from the bearing unless the tie 32 is cut. Since the tie 32 is a readily available item at any convenience store, cutting and removing the tie 32 from the bearing 30 should be of no concern to a user, when he or she desires to take down a flag for storage and use at a later time.

In use, a user opens the sealed flap 44 of the pouch 42 and removes the content for easy access. Next the user takes the individual segments of the flagpole 24 and assembles them into a single flagpole unit, which is now adapted to be mounted in a conventional flagpole mount (not shown). The user next, press fits in a snug friction tight fit, the bearing 30 to the top of the flagpole 24 as best seen in FIGS. 1 and 5. It is contemplated within the true scope and spirit of the present invention, that the outside diameter of the flagpole 24 in some circumstances may not accommodate the bearing 30 in a snug tight fix. In those situations, when there is a loose fit, the user may apply some quick setting glue from the bottle 60 to the top surface area of the flagpole 24 to help affix the bearing 30 to the flagpole 24.

The user then inserts the rod 20 into the top 19 of the side edge pocket 16 of the flag 12 until the rod 20 is fully inserted within the interior of the pocket 16. It should be noted that the bottom end of pocket 16 is permanently sown shut or sealed which act as a stop. In this regard, the user need only close the top opening 19 to the pocket 16, as will be explained hereinafter in greater detail, to assure that the rod 20 can not be dislodged from the pocket 16.

Once the rod 20 has been mounted within the pocket 16, the user passes the chain 34 through the eyelet 15, wraps the chain 34 around the flagpole 24 and closes the chain 34 upon itself using the clasp 36. The mounting of bottom portion of the flag 12 to the flagpole 24 in this manner is an important feature of the present invention as this mounting arrangement allows the bottom portion of the flag 12 to float relative to the flagpole 24. That is the chain 24 will rotate about the flagpole 24 through the eyelet 15 of the flag 12 so the bottom portion of the flag 12 floats and is prevented from wrapping around the flagpole 24.

Figure 7:
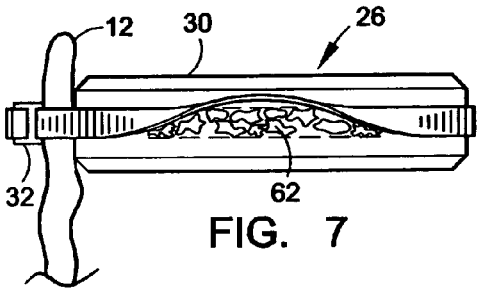
FIG. 7 is a cutaway side elevation view of the flag and mounting kit of FIG. 1.
Figure 6:
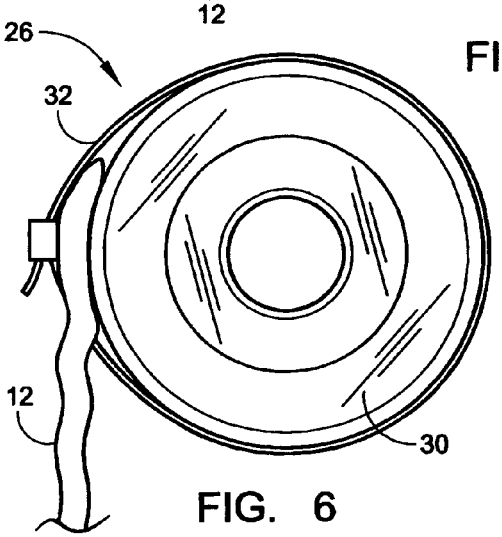
FIG. 6 is a top plan view of the flag and mounting kit of FIG. 1.

Next, the user using the top mounting arrangement 26 attaches the top portion of the flag 12 to the flagpole 24. In this regard, as best seen in FIGS. 5–7, the user passes the tie 32 through the eyelet 13, wraps the tie about the bearing 30 and cinches the tie 32 tight securing the tie 32 to the bearing 30. Any excess tie can be broken off to leave a clean end 34 as shown in FIG. 5.

If the user desires to permanently attach the tie 32 to the bearing 30, the user can place a spot of glue 62 from the bottle of glue 60 onto the bearing surface as shown in FIG. 7 prior to wrapping the tie 32 around the bearing 30 and cinching the tie in a tight fit against the bearing 30. For illustration purposes, the flagpole 24 has been intentionally omitted from FIG. 7. It should be understood however, by those skilled in the art that the bearing 30 and tie 32 may be attached to the flag 12 prior to the bearing 30 being pressed fit onto the flagpole 24.

Figure 4:
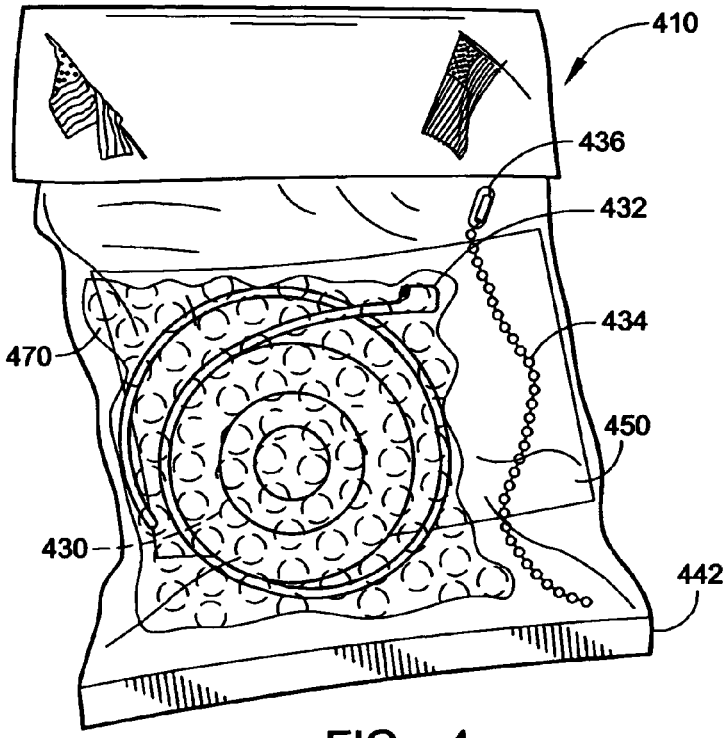
FIG. 4 is a perspective view of another packaged mounting kit, which is constructed in accordance with the present invention.

Referring now to the drawings and more particularly to FIG. 4 there is illustrated another flag mounting kit 410, which is constructed in accordance with the present invention. The flag mounting kit 410 is identical in construction to kit 10, except the kit 410 only includes a bearing 430, a tie 432 and mounting chain 434 with clasp 436. It this regard, a stiff hem flag must be provided by the user. The manner of using the kit 410 in accordance with a sheet of instructions 450 is substantially similar to kit 10 except there is no need to use the stiffener rod 20.

Figure 8:
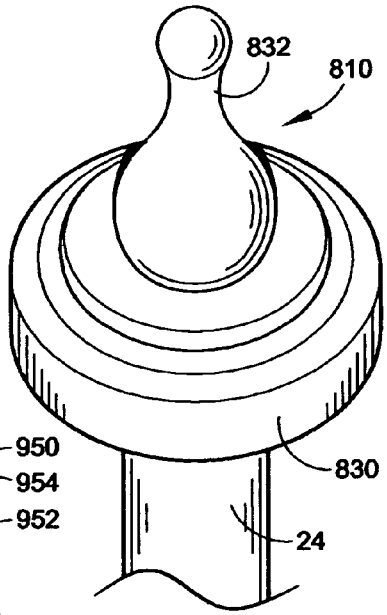
FIG. 8 is a perspective view of another mounting kit, which is constructed in accordance with the present invention.

Referring now to the drawings and more particularly to FIG. 8, there is illustrated another flag mounting kit 810 that is constructed in accordance with the present invention. The flag mounting kit 810 is identical to flag mounting kit 10 except that in this alternative embodiment, a seal bearing 830 is provided that includes a decoration fixture or cap top 832 that provides the flag pole 24 with a more finished ornamental structure. It is contemplated that different kinds and types of caps may be included in a kit, depending upon the preferences of the user. For example, the bearing 830 and the cap top 832 may be formed as an integral unit. Alternately, the bearing 830 and the cap top 832 may be separate units.

Figure 9:
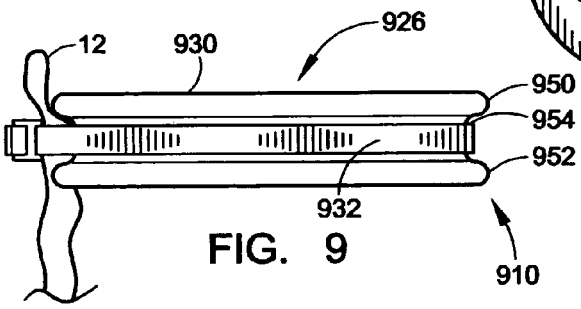
FIG. 9 is a side elevational view of yet another mounting kit, which is constructed in accordance with the present invention.

Referring now to the drawings and more particularly to FIG. 9, there is illustrated yet another flag mounting kit 910, which is constructed in accordance with the present invention. The flag mounting kit 910 is identical to flag mounting kit 10 except that in this alternative embodiment, an upper mounting arrangement 926 includes a seal bearing 930 and tie wrap 932. The seal bearing 930 is similar in construction to seal bearing 30 except that the bearing 930 includes an upper flange 950 and a lower flange 952 that cooperate to form a tie seat indicated generally at 954. This upper mounting arrangement 926 provides an alternative manner of permanently fixing the tie 932 to the bearing 930. The bearing 930 is an off the shelf item sold by Freeway located in Cleveland, Ohio as an ASF Series Type 1 Flanged Radial Bearing. In the preferred embodiment of the present invention, the bearing 930 is a stainless steel bearing; however, bearings of other compositions such as Teflon, plastic, and liquid are contemplated within the true scope and spirit of the claimed invention.

Considering now the mounting kit 10 is still greater detail, the mounting kit 10 when installed provides a flag mounting arrangement that generally includes an anchor point at a bottom portion of the flagpole 24 that is an unconstrained anchor point. That is the ball chain 34 is not affixed to the flagpole 24, instead the ball chain 34 is loosely wrapped around the flagpole 24 and loosely wrapped through the bottom eyelet 15 of the flag 12 and then closed upon itself. This is an important feature of the present invention since the flag 12 is not physically attached to the flagpole 24 but instead is only loosely coupled. The flag 12 is physically attached to the flagpole 24 in the upper mounting arrangement that includes the sealed bearing 30 and tie 32 which are affixed to one another in a constrained manner. In short, this is a constrained anchor. With this mounting arrangement, the flagpole-side edge portion of the flag 12 is constrained at it top portion and unconstrained at its bottom portion which allows the flag to freely rotate about the flagpole 24 without furling. It should be understood by those skilled in the art that due to the loose coupling of the flag 12 to the bottom portion of the flagpole 23, the stiff side edge of the flag hold the flag edge straight thereby helping to prevent furling.

It is evident that there are additional embodiments and applications of the improved flag mounting kit which are not disclosed in this detailed description, but which would clearly fall with the scope of said invention. For example, as best seen in FIG. 4, for shipping purposes to protect the shipping pouch 442, the bearing 430 can be wrapped and protected in an inner bubble wrap pouch 470. As another example, it is contemplated that the tie wrap and bearing may be affixed together by a strip of adhesive that is protected by a peel sheet until it is ready to be utilized. As still yet another example, rather than using a hook and pile closure for the flap 19, the tie wrap 32 when extended through the eyelet 13 could secure a stiffener within the pocket 16 when the pocket opening is disposed at a top edge of the flag. And still yet another example, the bearing can be made with a single flange surface. Based on the foregoing, this specification is intended therefore to illustrate and clarify the nature of this invention and not limit its scope.

We claim:

1. A mounting kit, consisting of:

a) a flag having a flagpole-side edge for helping hold the flagpole-side edge of said flag straight for full flag display purposes;

b) a pair of eyelets disposed on said flag and spaced from one another at about said flagpole-side edge for helping to facilitate anti furling purposes;

c) a flagpole;

d) a bearing having an inside diameter dimension selected to correspond to an outside diameter dimension of a flagpole;

e) a flexible coupler for tightly coupling one of said pair of eyelets to said bearing;

f) a flexible member for loosely wrapping around a bottom portion of said flagpole and loosely coupling through another one of said pair of eyelets;

g) wherein said bearing and said flexible coupler are secured together by an adhesive;

h) a set of instructions for directing a user in securing said bearing to the flagpole, securing the flag to said bearing, and for loosely coupling a bottom portion of said flag to said flagpole; and i) a container for holding said flag, said flagpole, said bearing, said flexible coupler and said flexible member.

2. The mounting kit according to claim 1, wherein said flag further includes a flagpole-side edge pocket disposed between a top edge of said flag and a bottom edge of said flag;

said pocket being dimensioned for receiving therein a stiffener for helping to keep the flagpole-side edge of said flag straight.

3. The mounting kit according to claim 2, wherein said bearing is a sealed bearing having a low coefficient of drag.

4. The mounting kit according to claim 3, wherein said flexible coupler is a tie.

5. The mounting kit according to claim 1, wherein said flexible member is a ball-chain having a closure clasp.

6. The mounting kit according to claim 1, wherein said adhesive is provided in a container of glue.

7. The mounting kit according to claim 1, wherein said adhesive is a strip of adhesive.

8. The mounting kit according to claim 1, wherein said flagpole is a segmented flagpole having at least two separate pieces.

9. An anti furling mounting arrangement kit, consisting of:

a) a flag having a flagpole-side edge for helping to hold the flagpole-side edge of said flag straight for full flag display purposes;

b) a pair of eyelets disposed on said flag and spaced from one another at about said flagpole-side edge for helping to facilitate anti flag furling purpose;

c) a flagpole;

d) a bearing having an inside diameter dimension selected to correspond to an outside diameter dimension of a flagpole;

e) a flexible coupler for tightly coupling one of said pair of eyelets to said bearing;

f) a flexible member for loosely wrapping around a bottom portion of said flagpole and loosely coupling through another one of said pair of eyelets;

g) wherein said bearing and said flexible coupler are secured together by an adhesive;

h) wherein said flag further includes a flagpole-side edge pocket disposed between a top edge of said flag and a bottom edge of said flag, said pocket being dimensioned for receiving therein a stiffener for helping to keep the flagpole-side edge of said flag straight;

i) a stiffener;

j) a set of instructions for directing a user in securing said bearing to the flagpole, securing the flag pole to said bearing, and for loosely coupling a bottom portion of the flag to said flagpole; and k) a container for holding said flag, said flagpole, said bearing, said flexible coupler, said flexible member, and said stiffener.

10. The anti furling mounting arrangement kit according to claim 9, wherein said flexible member is a ball-chain having a clasp for helping to loosely attach a bottom portion of the flag to the flagpole.

11. The anti furling mounting arrangement kit according to claim 10, wherein said stiffener comprises a dowel, wherein said dowel is a segmented dowel having at least two separate members.

12. The anti furling mounting arrangement kit according to claim 9, wherein said bearing has a sufficiently small inside diameter dimension to permit the bearing to be press mounted to said top portion of the flagpole in a friction tight fit.

13. The anti furling mounting arrangement kit according to claim 12, wherein said bearing is a sealed bearing.

14. The anti furling mounting arrangement kit according to claim 9, wherein said flexible coupler is a tie.

15. The anti furling mounting arrangement kit according to claim 14, wherein said bearing and said tie are adhesively secured together by a strip of adhesive.

16. The anti furling mounting arrangement kit according to claim 14, wherein said bearing includes an upper flange member and a lower flange member for helping to define a seat dimensioned for receiving therein said tie.

* * * * *